US006824963B2

(12) United States Patent
Fyson et al.

(10) Patent No.: US 6,824,963 B2
(45) Date of Patent: Nov. 30, 2004

(54) PROCESSING OF PHOTOGRAPHIC MATERIAL

(75) Inventors: John R. Fyson, London (GB); Peter J. Twist, Buckinghamshire (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/675,353

(22) Filed: Sep. 30, 2003

(65) Prior Publication Data

US 2004/0067457 A1 Apr. 8, 2004

Related U.S. Application Data

(62) Division of application No. 10/314,662, filed on Dec. 9, 2002.

(30) Foreign Application Priority Data

Dec. 11, 2001 (GB) ..... 0129545

(51) Int. Cl.[7] ..... G03C 5/26; G03C 5/305; G03C 7/30; G03C 7/407

(52) U.S. Cl. ..... 430/357; 430/401; 430/933

(58) Field of Search ..... 430/357, 401, 430/933

(56) References Cited

U.S. PATENT DOCUMENTS

| | | | | | |
|---|---|---|---|---|---|
| 5,266,986 | A | * | 11/1993 | Kobel | 355/32 |
| 5,534,395 | A | * | 7/1996 | Kamada et al. | 430/400 |
| 5,717,972 | A | | 2/1998 | Patton et al. | 396/515 |
| 5,968,718 | A | * | 10/1999 | Becher | 430/383 |
| 6,153,365 | A | * | 11/2000 | Goswami et al. | 430/455 |
| 6,605,420 | B2 | * | 8/2003 | Nakai et al. | 430/486 |
| 6,632,594 | B2 | * | 10/2003 | Nakai et al. | 430/486 |

* cited by examiner

*Primary Examiner*—Hoa Van Le

(57) ABSTRACT

A method of chemically marking photosensitive material that needs to be digitally scanned and adjusted rather than optically printed to produce a satisfactory hardcopy.

4 Claims, No Drawings

PROCESSING OF PHOTOGRAPHIC MATERIAL

CROSS REFERENCE TO RELATED APPLICATIONS

This is a divisional of application Ser. No. 10/314,662, filed Dec. 9, 2002, entitled PROCESSING OF PHOTOGRAPHIC MATERIAL, in the names of John R. Fyson et al.

FIELD OF THE INVENTION

This invention relates to processing photographic materials and in particular to films that will be printed digitally i.e. the negative or transparency is scanned to generate a stored digital image which is subsequently printed to generate a hard copy. This printing step might be by ink-jet, electrophotographic or photographic or any other suitable means.

BACKGROUND OF THE INVENTION

Once a film has been exposed it is then processed by being passed through various solutions, such as developer, bleach, fixer and wash solutions, to convert the latent image to a visible image. In certain circumstances it is not viable to have large tanks of processing solutions. In these cases small amounts of processing solutions are used, usually only in a single processing space. Thus solutions which are stable for only a short time can be used. This also leads to more rapid processing. It is known that in order to get rapid processing of multi layer color films, the temperature of the developer can be raised. This increases the rate of development in each layer, but usually the rate is different in each layer. The different rates of development in each layer cause a different contrast in each layer. If this rapidly processed film is printed optically this effect will show in the print and it will be impossible to get good color balance in densities of the image.

To some extent this imbalance of contrast can be overcome by changing the chemical composition of the developer or rebuilding the film. Unfortunately the variable contrast effect is different for every film and therefore there would have to be a different chemical composition of the developer for each film processed. This is impractical. One way around the problem is to digitally scan the film to produce a digital 'image'. This image can then be adjusted mathematically to balance the contrasts. The contrast correction look-up table can be stored for each film/developer/time/temperature combination.

It is however necessary to identify the process through which the film was processed. This could be done by attaching a suitable marking to the film or film container, notching the film or by 'writing' to any associated magnetic coating, such as on the back of an APS film. All of these methods are subject to error, either forgetting to put on the mark or marking with the wrong process identification.

It is known to add chemical indicators to a photographic solution to determine the exhaustion thereof. However these indicators do not remain in the processed product.

The aim of the invention is to mark a photosensitive material, such as a film negative or transparency, that has been processed in a non-standard process, such as rapid processing, and that requires digital scanning and contrast adjustment to print a good hardcopy, in a way that does not require human intervention or human setting up. The invention aims to mark the material inherently.

SUMMARY OF THE INVENTION

According to the present invention there is provided a method of chemically marking photosensitive material that has been processed in a particular way that necessitates digital scanning and contrast adjustment to produce a satisfactory hardcopy.

Preferably an optical brightner is included in the developer solution.

The invention provides a method in which no operator intervention is required to mark material which needs to be digitally scanned and processed to provide a satisfactory hard copy of an image. Thus the method is not subject to human error.

The chemical marker remains in the processed material. Therefore should any re-prints be required at a later date the operator of a mini-lab would be able to determine that scanning and digital optimization is required for satisfactory results.

It is possible that the method of processing could also be used when optical printing should the process affect only the speed or Dmin rather than the contrast. The marking would then alert the person printing the image optically to a different setting required in the enlarger or printer. This could be done automatically if the printer could detect the presence of the marker and react accordingly.

The invention can be used for both film and paper.

DETAILED DESCRIPTION OF THE INVENTION

When an exposed photosensitive material is to be processed it is passed through various solutions to convert the latent image to a visible image. For instance, with a color film the film is passed through a developer solution, a bleach solution, a fixer solution and finally a wash solution. This may be the same for both conventional processing and for non-standard processes such as rapid processing. Alternatively the non standard process may miss some of the steps after the developer is removed, to save time or chemistry, resulting in a scannable but not optically printable image.

According to the present invention one or more chemical compounds are added to one of the processing solutions used to process the material in a non-standard process. This or these compounds are not visible to a scanner or to an optical printer but can be detected by a specific physical method. Preferably the at least one chemical compound is added to the developer solution. However it is not essential to the invention that the compound is added to the developer solution. The chemical compound must remain in the material to some extent after processing.

One example of the method of processing is to put a fluorescent dye in the developer designed to produce a scan only film. The dye could, for example, be an optical brightner. This dye absorbs UV light of a wavelength shorter than that of the visible spectrum and fluoresces in the visible spectrum. The dye is at least partly retained within the film after processing. This could, for example, be within the film's gelatin matrix but equally may be in one of the other layers of the film. When scanning or optical printing the UV light can be filtered out with suitable absorbing filters.

Two experiments using different processing solutions for the processing of film are described below. It will be understood by those skilled in the art that they are examples only and the invention is not limited thereto.

EXAMPLE 1

The following processing solutions were made up:

| Developer 1 | |
|---|---|
| sodium sulfite anhydrous | 5 g |
| hydroxylammonium sulfate | 4 g |
| diethylenetriamine pentacetic acid | 2.6 g |
| sodium bromide | 1.2 g |
| sodium carbonate | 25 g |
| CD4 | 15 g |
| water to | 1 liter |
| pH adjusted to 10.03 | |

For the invention 2 g/l Phorwite™ REU was added.

| Bleach 1 | |
|---|---|
| Water | 700 ml |
| 1,3 PDT | 46 g |
| acetic acid glacial | 60 g |
| iron nitrate 42% | 78 g |
| ammonium bromide | 31 g |
| add ammonia and water in 100 ml portion to get pH 4.7 | |
| adjust volume to 1 liter | |
| adjust pH to 4.75 | |

| Fixer | |
|---|---|
| ammonium sulfite | 21.5 g |
| ammonium thiosulfate solution (56% w/w) | 200 ml |
| disodium EDTA.2H2O | 1 g |
| water to 1 liter | |
| pH adjusted to 6.5 with sulfuric acid | |

30 cm strips of Kodak Royal 400 and Kodak Ultra Zoom (800 speed) film were exposed to a neutral exposure wedge for 1/00s in a sensitometer and processed in upright processing tanks according to the following scheme:

| Process at 37.8° C. | Time |
|---|---|
| Developer 1 | 195 s |
| Bleach | 60 s |
| Fix | 90 s |
| Wash in running water | 90 s |
| Dry at room temperature | |

Samples processed with and without Phorwite™ REU were compared and the sensitometry was identical. The two strips were illuminated with UV of wavelength 366 nm and the strip processed with Phorwite™ in Developer 1 glowed a greenish color. The comparative strip did not. This shows that the strip processed with Phorwite™ in Developer 1 was marked without affecting the sensitometry but was easily detected by exposure to long wavelength UV light. Illumination of the strips with short 254 nm UV did not show the effect.

EXAMPLE 2

| Developer 2 | |
|---|---|
| sodium sulfite anhydrous | 10.5 g |
| hydroxylammonium sulfate | 3 g |
| diethylenetriamine pentacetic acid | 2.6 g |
| polyvinyl pyrrolidone (K15) | 3 g |
| sodium bromide | 2.8 g |
| sodium carbonate | 32.3 g |
| CD4 | 15 g |
| Kodak Photoflo | 0.5 g |
| water to | 1 liter |
| pH adjusted to 10.48 | |

For the invention 2 g/l Phorwite™ REU was added

| Stop-fix | |
|---|---|
| ammonium sulfite | 21.5 g |
| ammonium thiosulfate solution (56% w/w) | 350 ml |
| disodium EDTA.2H2O | 1 g |
| mercaptotetrazole | 2 g |
| Kodak Photoflo | 0.5 g |
| water to | 1 liter |
| pH adjusted to 4.25 with sulfuric acid | |

| Bleach 2 | |
|---|---|
| water | 300 ml |
| 1,3 PDTA | 157 g |
| succinic acid | 105 g |
| iron nitrate nonahydrate | 188.1 g |
| add ammonia and water in 100 ml portion to get pH 4.7 | |
| add water to 950 ml | |
| adjust pH to 4.75 | |
| adjust volume to 1 liter | |

90 cm strips of Kodak Royal 400 and Kodak Ultra Zoom (800 speed) film were exposed to a neutral exposure wedge for 1/00s in a sensitometer, three times along its length. The strips were put in a drum processor, such as is disclosed in GB 0023091.2, according to the following scheme:

| Process at 50° C. | Time | Volume |
|---|---|---|
| Developer | 130 s | 18 ml |
| Stop-Fix added on top of Developer 1 | 15 s | 12 ml |
| Bleach on top of previous mixture | 40 s | 12 ml |
| Remove solution | | |
| Wash in running water outside processor | 90 s | |
| Dry at room temperature | | |

Samples processed with and without Phorwite™ REU were compared and the sensitometry was identical. The two strips were illuminated with UV of wavelength 366 nm and the strip processed with Phorwite™ in Developer 2 glowed a greenish color. The comparative strip did not. This shows that the strip processed with Phorwite™ in Developer 2 was marked without affecting the sensitometry but was easily detected by exposure long wavelength UV light. Illumination of the strips with short 254 nm UV did not show the effect.

The examples described above use Phorwite™. However the invention is not limited thereto. Any optical brightner that is partially or wholly retained by photographic material, for instance in the gelatin, during processing should achieve satisfactory results.

The above examples have been described with respect to the developer solution. It will be understood by those skilled in the art that the method according to the invention could be used in any processing solution, for example in the fixer solution.

It is to be understood that various modifications and changes may be made without departing from the present invention, the present invention being defined by the following claims.

What is claimed is:

1. A method of chemically marking photosensitive material that has been processed in a particular way that necessitates digital scanning and contrast adjustment to produce a satisfactory hardcopy.

2. A method as claimed in claim 1 wherein at least one chemical compound is added to a solution in which the material is to be processed.

3. A method as claimed in claim 2 wherein an optical brightner is added to the solution.

4. A method as claimed in claim 2 wherein the solution to which the chemical compound is added is the developer solution.

* * * * *